United States Patent [19]

Tekip et al.

[11] Patent Number: 4,799,067

[45] Date of Patent: Jan. 17, 1989

[54] APPARATUS FOR SUPPORTING AN ELECTRONIC RECEIVING OR SENDING DEVICE ON A TRIPODAL TOWER

[76] Inventors: Gary L. Tekip, 4152 Waynesburg Rd., Carrollton, Ohio 44615; Charles A. Mesko, 4747 W. Tuscarawas, Canton, Ohio 44708

[21] Appl. No.: 118,725

[22] Filed: Nov. 9, 1987

[51] Int. Cl.[4] ..... H01Q 1/12

[52] U.S. Cl. ..... 343/890; 343/891

[58] Field of Search ..... 343/878, 890, 891, 885, 343/720, 840, 874, 879

[56] References Cited

U.S. PATENT DOCUMENTS

| | | | |
|---|---|---|---|
| 3,247,516 | 4/1966 | Rohn et al. | 343/890 |
| 4,356,498 | 10/1982 | Pollard | 343/890 |
| 4,510,502 | 4/1985 | Hovland et al. | 343/890 |
| 4,723,128 | 2/1988 | Gasque et al. | 343/892 |

FOREIGN PATENT DOCUMENTS

| | | |
|---|---|---|
| 0208037 | 1/1987 | European Pat. Off. . |
| 1252840 | 8/1986 | U.S.S.R. . |

OTHER PUBLICATIONS

Microwave Towers by Tower Construction Co., Sioux City, Iowa, Dec. 1959.

*Primary Examiner*—William L. Sikes
*Assistant Examiner*—Doris J. Johnson
*Attorney, Agent, or Firm*—David E. Wheeler

[57] ABSTRACT

An apparatus and a method for supporting an electronic receiving or sending device on a tripodal tower are provided. The apparatus comprises a number of interconnected struts, braces, and support means connected to each other in a relationship that tends to counter or transfer twisting forces or torques caused by the wind resistance of said device into up and down forces that are easily countered by the tower. A method is provided, using the apparatus of the invention, for supporting a device on a tripodal tower.

12 Claims, 1 Drawing Sheet

APPARATUS FOR SUPPORTING AN ELECTRONIC RECEIVING OR SENDING DEVICE ON A TRIPODAL TOWER

BACKGROUND OF THE INVENTION

1. Prior Art

Rohn et. al., in U.S. Pat. No. 3,247,516 issued Apr. 19, 1966, describe a microwave reflector that is mounted on a tripodal tower using angled iron.

Weir, in U.S. Pat. No. 4,490,726 issued Dec. 25, 1984, describes a collapsible roof top microwave antenna with a wind loading feature.

Edwards, in U.S. Pat. No. 4,565,346 issued Jan. 21, 1986, describes an adjustable bracket mount for a satellite dish antenna.

2. Background

The present invention relates to an apparatus for supporting a sending or receiving device on a tripodal tower.

New installations of satellite dish antennas for television are controlled by local regulations, and depending on the jurisdiction may be installed at a maximum height, for example, of fifteen feet. Usually this installation is made atop a single fifteen foot section of four inch or six inch hot rolled tubing, or a squared version of such tubing. The local regulations are based on safety requirements which seem to indicate that installation higher than fifteen feet using such materials is unsafe. Because houses and trees are often higher than fifteen feet and block microwave and other signals, the fifteen foot height limitation makes it necessary for the television owner to install the dish antenna on top of the nearest hill, or alternatively, to install the antenna in a large flat open area with no obstructions, and run great lengths of cable from the antenna to his television. In highly populated areas there are a great many more man made obstructions, and disputes over easements may make installation of the antenna large distances from the television impractical.

Although a new installation cannot be made higher than fifteen feet, there are few regulations relating to the installation of dish antennae on existing structures such as a roof on a high rise building, if adequately supported, or an existing television antenna tower. Many jurisdictions have regulations against installing dish antennas on house roofs.

The difficulty and the resulting expense of providing adequate support on a roof or other high structure which is not otherwise suitable for supporting a dish antenna renders the use of such structures, in most cases, impractical.

Existing television towers, especially those of the tripodal type, having three legs, which are connected to each other by connecting braces, firmly implanted in the ground, in from three to six feet of concrete, depending on the height of the tower, have great structural strength. Because no alteration of the tower need be made, if a means could be provided, that is not too complicated or expensive to install, for supporting a dish antenna on an existing television tower, all the problems delineated above could be avoided.

It has been found that the problem with installing a dish antenna on an existing television tower is that such antennas have large wind resistance, and depending on the directional requirements of the antenna, and the direction of the wind, the wind resistance of the antenna may cause severe twisting forces, or a torque to be exerted on the tower by the antenna, and although a tripodal television tower is structurally strong, if strong forces are exerted on such a tower unevenly at one point, the tower could crumble. Also, the support means used for holding the dish antenna on the tower must be strong enough to withstand such forces and must be attached to the tower in a manner that prevents its separation from the tower when such forces are present.

Accordingly, there is a need in the art for a low cost, easily installed apparatus having sufficient strength to support a dish antenna on a tripodal tower, and a means for converting twisting and torque forces exerted by the apparatus on the tower into harmless up or down forces which can be easily handled by the tower.

SUMMARY OF THE INVENTION

It is a feature of the present invention to provide a low cost, easily installed apparatus having sufficient strength to support a dish antenna on a tripodal tower, and a means for distributing or converting twisting and torque forces exerted by the apparatus on the tower into harmless up or down forces which can easily be handled by the tower.

The present invention provides an apparatus for supporting a sending or receiving device on a tripodal tower having two base posts and an apex post. The apparatus comprises a base bar which is adapted to be attached to the two base posts of the tower; two side bars and a front bar, said side bars each having one end attached to opposed ends of the base bar and their other ends attached at or near the center of the front bar to form a platform having a planar geometric shape with the front bar being tangent to said geometric shape and substantially parallel to the base bar. The planar geometrically shaped platform comprising the front bar, base bar and side bars is adapted to be attached to the tower at a substantially right angle, horizontal to the ground. The platform is supported on the tower using two side struts, and a center strut, one end of each side strut being attached to opposed ends of the front bar, and the other end of each side strut being adapted to be attached to opposed base posts of the tower at points below the plane of the platform; the center strut having one end attached at or near the center of the front bar and the opposite end attached to the apex post of the tower, also at a point below the plane of the platform. Means are provided for converting twisting and torque forces exerted on the apparatus into up and down forces on the tripodal tower, optionally in the form of two cross braces, optionally connected to the side struts, each having one end connected to a base post at or below the point of attachment of the side struts, and the other end of each connected to the apex post at or above the plane of attachment of the platform.

The method of the invention comprises supporting a sending or receiving device on a tripodal tower by the steps of providing the apparatus of the invention, attaching the base bar to the base posts of the tower, attaching the side struts to the base posts of the tower at a point below the base bar, attaching the center strut to the apex post of the tower, and attaching the sending or receiving device to a mount on the planar geometrically shaped platform.

DESCRIPTION OF THE PREFERRED EMBODIMENT

Figure 1:
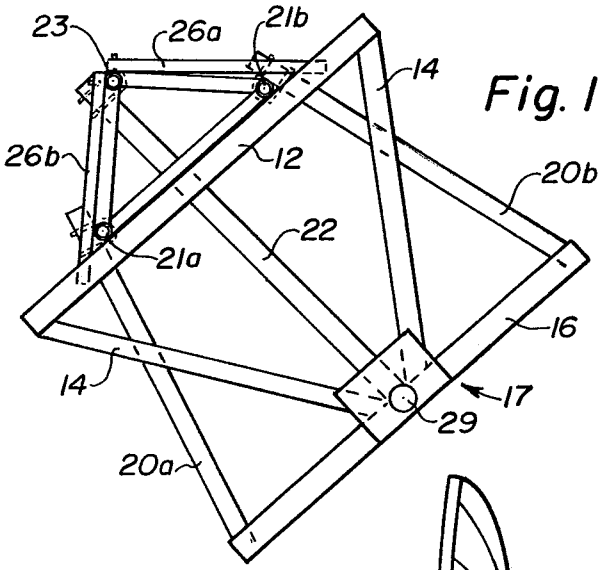
FIG. 1 Illustrates a top view of the apparatus of the invention attached to a tripodal tower.

Reference is now made to FIG. 1 which illustrates a top view of the apparatus of the invention attached to a tripodal tower 10. The apparatus of the invention comprises a base bar 12, which together with two side bars 14 and front bar 16 form planar geometrically shaped platform 17.

In the illustrated embodiment, platform 17 describes the open area encompassed by base bar 12, side bars 14 and front bar 16. To minimize the weight of the apparatus of the invention, it is preferred that the platform area 17 be open, but it will be recognized by those skilled in the art that the invention may be practiced having a solid material attached to and connecting base bar 12 and side bars 14, and front bar 16.

Figure 2:
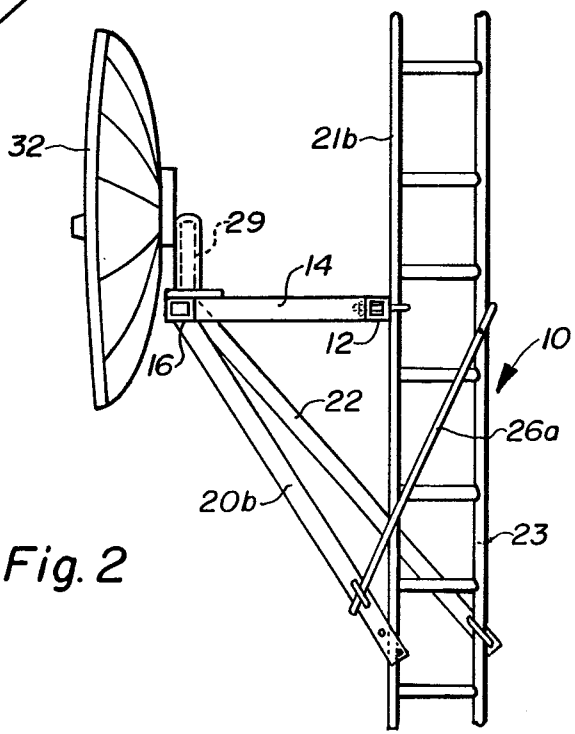
FIG. 2 Illustrates a side, slightly elevated view of the apparatus of the invention with a dish antenna adapted to be attached to a tripodal tower.

Reference is now made to FIG. 2 which is a side view of the apparatus of the invention attached to a tripodal tower 10. Side struts 20 each have one end attached to front bar 16 and the opposite end attached to a base post 21 of tripodal tower 10, and provide upward support for platform 17. Similarly, center strut 22 has one end attached to front bar 16 and the opposite end attached to apex post 23 of tripodal tower 10. As is known in the art, the two base posts and the apex post of the tower are connected to each other by the use of connecting braces that are welded to said posts at regular intervals throughout the length of the tower.

Figure 3:
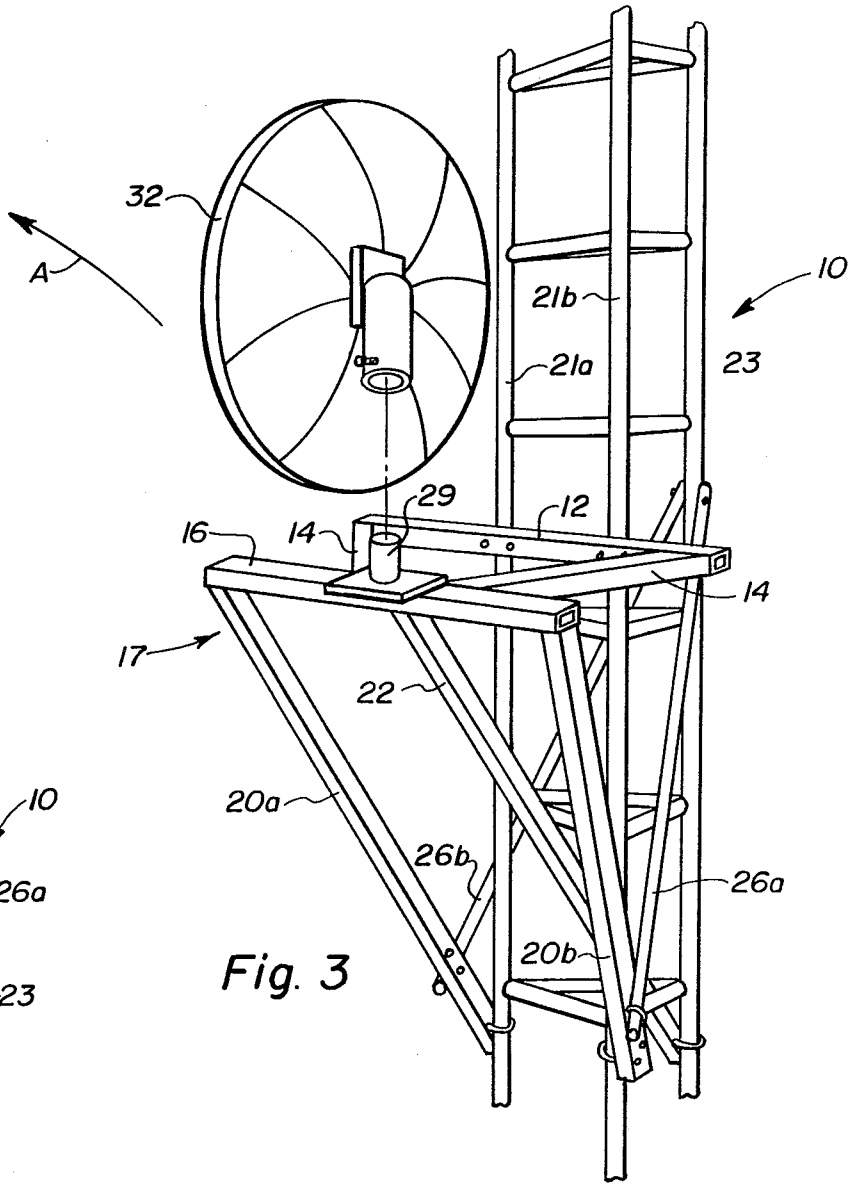
FIG. 3 Illustrates a front, slightly elevated view of the apparatus of the invention attached to a tripodal tower.

Reference is now made to FIG. 3 which illustrates a perspective front view of the apparatus of the invention. Two cross braces 26 each are connected to a side strut 20. The cross braces 26 are configured such that one end of each cross brace 26 is attached to side strut 20 at or near the point where side strut 20 is attached to base post 21 of tripodal tower 10, and the opposite end of cross brace 26 is attached to apex post 23 at or near the plane of base bar's 12 point of attachment to the tripodal tower 10. An optional transverse brace may be provided, attached to both cross braces 26 to solidify cross braces 26. A mount 29 is provided on platform 17 for holding the sending or receiving device, illustrated in FIG. 2 as dish antenna 32.

In the illustrated embodiment, cross braces 26 provide means for converting and redistributing torque and twisting forces exerted on the apparatus into harmless up and down forces on the tripodal tower.

It will be recognized by those skilled in the art that a first end of cross brace 26 may be attached to base bar 12, or to a base post 21 near the point of attachment of base bar 12 to base post 21, and the second end thereof may be attached to apex post 23 near the point of attachment of center strut 22. Such a configuration will have similar structural effect on the apparatus and the tripodal tower as the configuration in the drawing.

Similarly, a cross brace may be provided wherein a first end may be attached to base bar 12 near base post **21*a*, or to base post 21*a* near base bar 12, and a second end thereof may be attached to base post 21*b* near side strut 20*b*. In such an embodiment, a second cross brace will be attached to the apparatus or the tripodal tower with a first end at or near base post 21*b* at or near base bar 12, and a second end at or near side strut 20*a* at or near base post 21*a***.

In the illustrated embodiment, platform 17 is illustrated as having a generally triangular shape where side bars 14 are attached to each other as well as to base bar 12 and front bar 16. In the illustrated embodiment, mount 29 is attached at or near apex point 34 of the triangle where the two side bars 14 are attached to each other.

Although the present apparatus has been illustrated as having a platform 17 having a triangular shape, and side struts 20 forming a trapezoid with front bar 16 and base posts 21 of tripodal tower 10, it will be recognized by those skilled in the art that the present invention would also be functional if platform 17 has a trapezoidal or similar geometric shape, or if side struts 20 are in a crossing configuration forming an asymetrical X and are attached to each other where they meet. Other possible configurations of the present apparatus which are within the scope of the claims will be apparent to those skilled in the art.

In its preferred embodiment, the apparatus of the invention will be provided with 2 pipe clamps on base bar 12 for attachment to each base post 21 of the tripodal tower 10, one pipe clamp on each side strut 20 for attaching one of the side struts 20 to each base post 21, and one pipe clamp attached to center strut 22 for attaching the center strut 22 to the apex post 23. Those skilled in the art will recognize that the apparatus may be attached to tower 10 by welding if a more permanent connection is desired.

The apparatus of the invention need not be attached to the top of tower 10, but may be attached at any desired height on the tower depending on the requirement of height caused by the height of surrounding obstructions.

In its operation, side struts 20 and center strut 22 primarily provide support for any downward forces encountered by the apparatus, such as is encountered by the effect of gravity on a sending or receiving device mounted on platform 17. When a dish antenna 32 is mounted on the apparatus, and the wind impinges on the antenna from the direction of arrow A (FIG. 3), there is a downward and inward force exerted on side strut **20*a* and an upward and outward force exerted on side strut 20*b*. That is, platform 17 has a tendency to twist in a counter clockwise direction in the view illustrated in FIG. 3. When such a force is exerted on platform 17, cross brace 26*a* provides support against the twisting force on tower 10 to resist the upward movement of the right side of platform 17, and redistributes or converts the twisting force of the platform into an upward force on the base post 21*a* and apex post 23 of tower 10, and cross brace 26*b* acts to support the tower 10 against downward movement of the left side of platform 17 and redistributes or converts the twisting force of the platform into a downward force on the base post 21*b* and apex post 23. An optional transverse brace my be used to provide support to cross braces 26 in converting the forces as indicated and help maintain the spatial relationship of the base posts 21 and apex post 23 of tower 10. The upward and downward forces exerted on the base posts 21 in this manner are distributed throughout the full length of the tower and absorbed in the connecting braces that hold the base posts 21 and apex post 23 of the tower together. In the combination of the apparatus of the invention with a tripodal tower, similar effects are observed no matter which direction the twisting forces are exerted on tower 10** by the sending or receiving device.

It will be recognized by those skilled in the art that the apparatus of the present invention may be used on a quadrapodal tower by attaching the center strut 22 to a cross bar connecting the two legs of the tower that are farthest from the apparatus. Such a cross bar would be equivalent to the apex post of a tripodal tower.

In the method of the invention the apparatus is attached to the tripodal tower by attaching base bar 12 to the two base posts 21 of tripodal tower 10, preferably by using pipe clamps, attaching each side strut 20 to a base post 21 of tower 10 at a point below the level of attachment of base bar 12, preferably using pipe clamps, and attaching center strut 22 to apex post 23 of tower 10 at approximately the same level of attachment as side struts 20, also using a pipe clamp. Cross braces 26 each may then be attached to apex post 23 using a U-clamp and to base bar 12 using a nut and bolt, or in an alternative embodiment, to base posts 21 and apex post 23 using U-clamps.

While being illustrated as a means for supporting a dish antenna, it will be recognized by those skilled in the art that the apparatus of the present invention may be used to support any type of device that may be used on a tripodal tower. Electronics sending and receiving devices are particularly applicable for use with the present invention.

The apparatus of the present invention may be made of any material that provides the structural strength needed for the purposes described. Particularly preferred for base bar 12, side bars 14, front bar 16, side struts 20 and center strut 22 would be the use of 1½ inch angles iron or 1½ inch iron pipe or squared iron pipe. For cross braces 26 and an optional tranverse brace, 1 inch angled iron can be used or ½ inch cold rolled steel can be used. Standard ¾ inch or 1 inch U clamps may be used to attach the apparatus to tower 10.

While present embodiments of the invention and methods of practicing the same have been illustrated and described, it will be recognized by those skilled in the art that the invention may be otherwise variously embodied and practiced within the scope of the following claims.

What is claimed is:

1. An apparatus for supporting a sending or receiving device on a tripodal tower having two base posts and an apex post, said apparatus comprising a base bar adapted to be attached to said two base posts of said tower; two side bars and a front bar, said side bars each having a first end attached to opposed ends of said base bar and a second end thereof attached to said front bar to form a substantially planar geometrically shaped platform with said front bar being substantially parallel to said base bar, said platform being adapted to be attached to said tower at a substantially right angle and substantially horizontal to the ground; two side struts having a first end of each being attached to opposed ends of said front bar, and a second end of each being attached to opposed base posts of said tower at points below the plane of said platform; and a center strut having a first end attached to substantially the center of said front bar and a second end attached to the apex post of said tower.

2. The apparatus according to claim 1 in which said geometrically shaped platform is substantially a triangle having said base bar as a base, and an apex point where said second ends of said side bars converge.

3. The apparatus according to claim 1 which has a mount attached to said platform for holding said receiving or sending device.

4. The apparatus according to claim 2 which has a mount attached to said triangle substantially at said apex point.

5. The apparatus according to claim 1 further comprising two cross braces each having one end attached to opposed base posts of said tripodal tower proximal to the attachment of said side struts and its opposite end attached to said apex post proximal to the attachment of said platform.

6. The apparatus according to claim 5 in which one end of each said cross brace is attached to a side strut.

7. The apparatus according to claim 5 in which the configuration of said base bar, side bars, front bar, side struts, center strut, and cross braces cause the torques and other twisting forces caused by the wind striking said receiving or transmitting device to be transferred and converted into a lifting or a downward force on said tower.

8. A method for supporting a sending or receiving device on a tripodal tower having two base posts and an apex post, said method comprising the steps of: providing an apparatus consisting of a base bar adapted to be attached to said two base posts of said tower, two side bars and a front bar, said side bars each having one end attached to opposed ends of said base bar and the other ends thereof attached to said front bar to form a substantially planar geometrically shaped platform with said front bar being substantailly parallel to said base bar, said platform being adapted to be attached to said tower at a substantially right angle and substantially horizontal to the ground, two side struts one end of each being attached to opposed ends of said front bar, and the other end of each being attached to opposed base posts of said tower at points below the level of said platform, a center strut having on end attached to substantially the center of said front bar and the opposite end attached to the apex post of said tower at a point below the level of said platform, and a mount attached to said platform for holding said receiving or sending device; attaching said base bar to said base posts of said tower; attaching said side struts to said base posts at a point below the level of said base bar; attaching said center strut to the apex post of said tower at about the same level of attachment of said side struts; and attaching said receiving or sending device to said mount.

9. A method according to claim 8 which comprises the further step of providing said geometric shape in the form of a triangle having said base bar as a base and an apex point where said other ends of said side bars meet and are attached to each other.

10. A method according to claim 9 which comprises the step of attaching said mount to said triangle substantially at the apex point.

11. A method according to claim 8 which comprises the further step of clamping said apparatus to the tower at all point of attachment.

12. A method according to claim 8 which comprises the further step of configuring said base bar, side bars, front bar, side struts, and center strut, and in a relationship causing the torques and other twisting forces caused by the wind striking said receiving or transmitting device to be transferred and converted into a lifting or downward force on said tower.

* * * * *